United States Patent [19]

Garneau

[11] 4,358,064

[45] Nov. 9, 1982

[54] PIPE WRAPPING MACHINE

[76] Inventor: Maurice N. Garneau, Box 137, Nisku, Alberta, Canada, T0C 2G0

[21] Appl. No.: 225,661

[22] Filed: Jan. 16, 1981

[30] Foreign Application Priority Data

Feb. 5, 1980 [CA] Canada ..... 345098

[51] Int. Cl.[3] ..... B65H 81/08

[52] U.S. Cl. ..... 242/7.23; 57/10; 156/428; 242/68.3

[58] Field of Search ..... 57/3, 10; 156/392, 428, 156/431, 433, 443, 459; 242/7.01, 7.13, 7.23, 7.22, 68.3

[56] References Cited

U.S. PATENT DOCUMENTS

| | | | |
|---|---|---|---|
| 2,275,858 | 3/1942 | Mallard | 57/10 X |
| 4,008,114 | 2/1977 | Lindsey | 156/392 |
| 4,069,088 | 1/1978 | Cottam | 242/7.23 X |
| 4,261,785 | 4/1981 | Hunter | 156/392 |

FOREIGN PATENT DOCUMENTS

| | | | |
|---|---|---|---|
| 765790 | 1/1957 | United Kingdom | 156/392 |
| 1027047 | 4/1966 | United Kingdom | 156/392 |

*Primary Examiner*—Billy S. Taylor

*Attorney, Agent, or Firm*—George H. Dunsmuir

[57] ABSTRACT

A machine for wrapping a pipe with tape or another strip of material includes a frame defined by a pair of spaced apart V-shaped ends, which are interconnected at their vertices by a roll of tape, the ends having wheels and straddling a pipe so that the tape can be unwound onto the pipe when the frame is rotated around the pipe, and one of the frame ends is rotatable relative to the other end so that the wheels on one end can be moved out of alignment with the wheels on the other end to change the path of travel of the frame on the pipe from circular to helical or to lengthen the helix.

4 Claims, 5 Drawing Figures

PIPE WRAPPING MACHINE

BACKGROUND OF THE INVENTION

This invention relates to a pipe wrapping machine, and in particular to a manually operated machine for wrapping pipes with tape or other material in strip form.

The vast majority of commercially available pipe wrapping machines are bulky, electrically or mechanically operated machines, which are not adapted for ready use in the field. Moreover, the wrapping machines of the prior art are not adapted to wrap pipes completely to their ends. Usually, it is necessary to wrap the pipe ends manually.

Examples of prior art devices are disclosed by U.S. Pat. Nos. 2,361,014, issued to M. J. Crass on Oct. 24, 1944; 2,726,705, issued to P. F. Marx et al on Dec. 13, 1955; 3,000,167, issued to P. Pierce, Jr., on Sept. 19, 1961; 3,374,615, issued to J. Evanicsko, Jr., on Mar. 26, 1968; 4,008,114, issued to C. P. Lindsey on Feb. 15, 1977; and 4,069,088, issued to S. D. Cottam on Jan. 17, 1978. It will be noted that most of the apparatus are somewhat heavy and complicated.

It is readily apparent that there exists a need for a simple pipe wrapping machine, which can be operated manually and which can be used to wrap the pipe substantially completely to its end. The object of the present invention is to provide a machine which is relatively uncomplicated, and which is capable of wrapping more or less the entire length of a pipe.

SUMMARY OF THE INVENTION

Accordingly, the invention relates to a machine for wrapping a pipe with a strip of material comprising a frame, said frame including a pair of substantially inverted V-shaped ends for straddling a pipe to be wrapped; bracket means located substantially at the vertex of each said end for rotatably supporting a roll of said material between said ends; roller means rotatably mounted on each arm of each said end for movably supporting said frame on a pipe to be wrapped; and adjustment means on one said end for moving one end relative to the other frame end, so that the rollers on one end are out of alignment with the rollers on the other frame end, whereby when the frame is moved on a pipe with the free end of the material attached to the pipe, the frame and the tape follow a helical path of travel along the pipe.

BRIEF DESCRIPTION OF THE DRAWINGS

The invention will now be described with reference to the accompanying drawings, which illustrate a preferred embodiment of the invention, and wherein.

DESCRIPTION OF THE PREFERRED EMBODIMENTS

Figure 1:
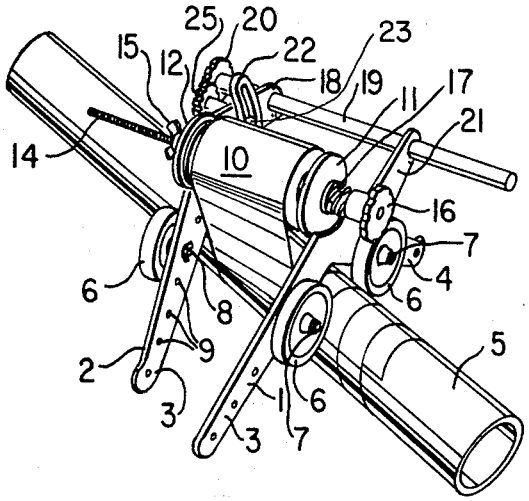
FIG. 1 is a perspective view of a pipe wrapping machine in accordance with the present invention from one end and above.
Figure 2:
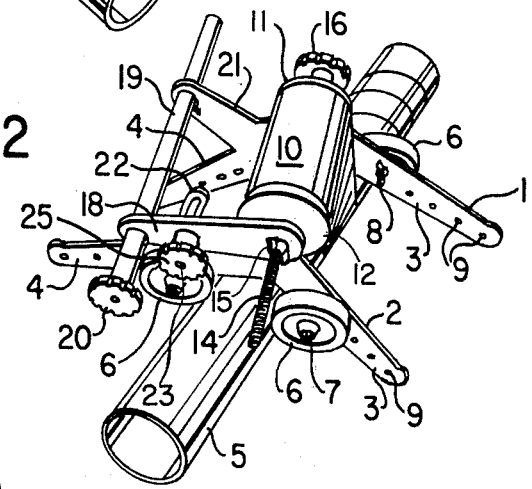
FIG. 2 is a perspective view of the machine of FIG. 1 from the other end and above.
Figure 3:
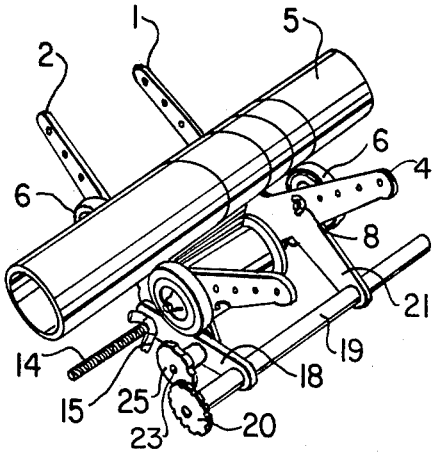
FIG. 3 is a perspective view of the machine of FIGS. 1 and 2 from below and the same end as FIG. 2.

With reference to the drawings, a pipe wrapping machine in accordance with the present invention includes a frame defined by a pair of spaced apart, generally inverted V-shaped ends 1 and 2, each defined by a pair of arms 3 and 4. In use, the ends 1 and 2 are supported on a pipe 5 by rollers 6. The rollers 6 are rotatably mounted on the arms 3 and 4 by means of bolts 7 and wing nuts 8, so that the rollers can readily be removed. A plurality of apertures 9 are provided along the length of each arm 3 and 4, so that the position of the rollers 6 can be changed depending on the diameter of the pipe 5 to be wrapped. In use the end frames are inter-connected by elongated bolt 14, which slips through bracket 11 and is locked to bracket 12 by wing nut 14. Bracket 11 and 12 are held apart by tape roll 10, bracket 11 is held in place by a pressure spring 17 working against adjustment knob 16. Each bracket 11 and 12 includes a series of discs for supporting the roll 10. Thus rolls having cores with various different diameters can be mounted between end frame 1 and 2. Elongated bolt 14 can be extended through bracket 12 to accommodate various widths of rolls. Roll 10 rotates about the stationary discs on bracket 11 and 12. The friction caused by the core turning against the stationary disc causes tension in the tape being applied. This tension can be varied by adjusting the pressure spring 17 with adjustment knob 16 which urges brackets 11 and 12 toward each other.

Figure 4:
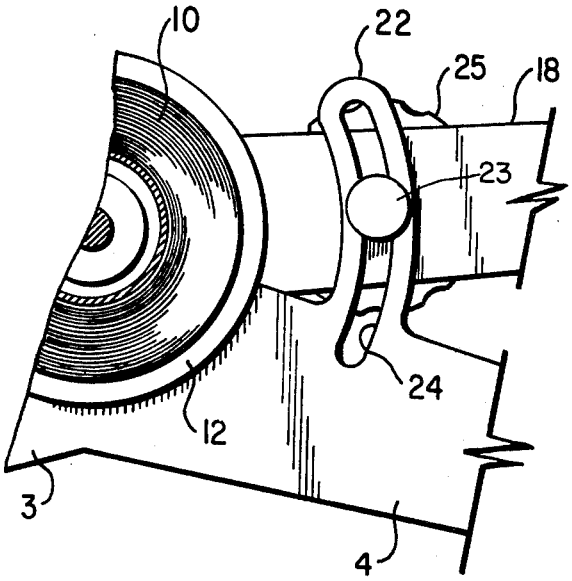
FIG. 4 is a front view of an adjustment mechanism of the machine of FIGS. 1 to 3.
Figure 5:
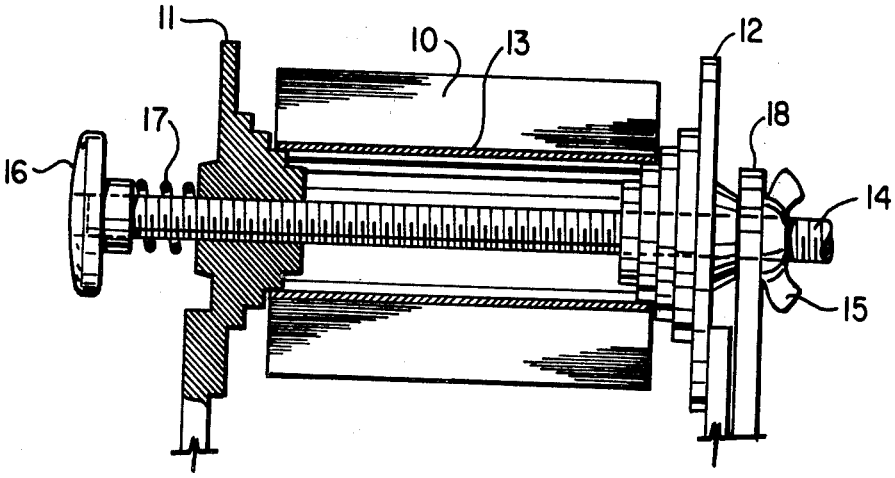
FIG. 5 is a cross-sectional view of a roll of tape and a partly sectional view of the brackets used to hold such roll on the machine of FIGS. 1 to 3.

One end of a straight arm 18 is pivotally mounted on the bolt 14 between the outer end of bracket 12 and the wing nut 15. The arm 18 extends outwardly from the roll 10 for pivotally supporting one end of an elongated handle 19. The handle 19 includes a scalloped knob 20 at one end which locks handle 19 to arm 18 and extends through an aperture in an elongated support 21 projecting outwardly from one arm 4 of frame end 2. The arm 18 forms part of adjustment mechanism which permits rotation of one end 2 relative to the other frame end 1, so that the rollers on one end will be out of alignment with the rollers 6 on the other end. The adjustment mechanism (FIG. 4) also includes an arcuate guide arm 22 integral with and extending upwardly from one arm 4 of the frame end 2. A bolt 23 extends through a slot 24 in the arm 22, through an aperture in the arm 18 into an internally threaded knob 25. By loosening the knob 25, the end 2 can be rotated around the axis of the bolt 14 relative to the end 2 so that the rollers 6 on one end 1 of the frame are moved out of or into alignment with the rollers 6 on the other end 2 of the frame.

If the rollers 6 on both ends of the frame are aligned, rotation of the frame around the pipe 5 defines a circular path. In other words, if the free end of the roll 10 of tape is secured to the pipe 5, and the frame is rotated around the pipe using the handle 16, the tape is merely wrapped around the pipe to form a cylinder. If, on the other hand, the knob 25 is loosened and the end 2 is rotated relatively to the end 1 so that the wheels of one end 1 are out of alignment with the wheels of the other end 2, rotation of the frame on the pipe 5 results in helical wrapping of the pipe with the tape. The greater misalignment of the wheels at one end with those at the other end of the frame, the longer the helix defined by the tape on the pipe 5. Because the length of the helix can be adjusted, it will be appreciated that the pipe can be wrapped completely to its end.

Further modifications and alternative embodiments of the invention will be apparent to those skilled in the art in view of the foregoing description. Accordingly, this description is to be construed as illustrative only and is for the purpose of teaching those skilled in the art, the manner of carrying out the invention. It is further understood that the form of the invention herewith shown and described is to be taken as the presently preferred embodiment. Various changes may be made in the shape, size and general arrangement of components, for example, equivalent elements may be substituted for those illustrated and described herein, parts may be used independently of the use of other features, all as will be apparent to one skilled in the art after having the benefits of the description of the invention.

What I claim is:

1. A machine for wrapping a pipe with a strip of material comprising a frame, said frame including a pair of substantially inverted V-shaped ends for straddling a pipe to be wrapped; bracket means including axle means located substantially at the vertex of each said end for rotatably supporting a roll of said material between said ends; roller means rotatably mounted on each arm of each said end for movably supporting said frame on a pipe to be wrapped; and adjustment means on one said end for moving one end relative to the other frame end, so that the rollers on one end are out of alignment with the rollers on the other frame end, whereby when the frame is moved on a pipe with the free end of the material attached to the pipe, the frame and the tape follow a helical path of travel along the pipe.

2. A machine according to claim 1, wherein said bracket means are integral with said ends.

3. A machine according to claim 1, wherein said axle means includes a bolt supporting said roller means on each said arms; and wherein a row of apertures are provided on each said arm for receiving said bolt, whereby the location of said roller means can be adjusted depending on the size of the pipe.

4. A machine according to claim 1, 2, or 3, including handle means extending between said ends for rotating said frame on a pipe.

* * * * *